US009159286B2

(12) United States Patent
Enomoto et al.

(10) Patent No.: US 9,159,286 B2
(45) Date of Patent: Oct. 13, 2015

(54) DISPLAY PANEL, LIQUID-CRYSTAL DISPLAY DEVICE AND DRIVE METHOD

(75) Inventors: Hiromi Enomoto, Osaka (JP); Shinsuke Yokonuma, Osaka (JP); Yoji Inui, Osaka (JP); Toshihiko Miyashita, Osaka (JP); Hiroyuki Kitamura, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 562 days.

(21) Appl. No.: 13/515,178

(22) PCT Filed: Oct. 28, 2010

(86) PCT No.: PCT/JP2010/069202

§ 371 (c)(1),
(2), (4) Date: Jun. 11, 2012

(87) PCT Pub. No.: WO2011/074333

PCT Pub. Date: Jun. 23, 2011

(65) Prior Publication Data

US 2012/0262363 A1 Oct. 18, 2012

(30) Foreign Application Priority Data

Dec. 18, 2009 (JP) ..... 2009-288446

(51) Int. Cl.
*G09G 3/36* (2006.01)

(52) U.S. Cl.
CPC ..... *G09G 3/3677* (2013.01)

(58) Field of Classification Search
None
See application file for complete search history.

(56) References Cited

U.S. PATENT DOCUMENTS

| | | | | |
|---|---|---|---|---|
| 6,407,729 | B1 | 6/2002 | Moon | |
| 8,026,883 | B2 * | 9/2011 | Meng et al. | 345/87 |
| 2002/0011982 | A1 | 1/2002 | Takeuchi et al. | |
| 2008/0001882 | A1 | 1/2008 | Lee | |
| 2008/0079001 | A1 * | 4/2008 | Umezaki et al. | 257/59 |
| 2008/0117155 | A1 * | 5/2008 | Li et al. | 345/91 |
| 2010/0230680 | A1 * | 9/2010 | Seong et al. | 257/59 |

FOREIGN PATENT DOCUMENTS

| | | |
|---|---|---|
| EP | 0 423 887 | 4/1991 |
| JP | 3-144609 | 6/1991 |

(Continued)

OTHER PUBLICATIONS

Search Report mailed Nov. 30, 2010, directed to International Patent Application No. PCT/JP2010/069202; 4 pages.

*Primary Examiner* — Adam R Giesy
*Assistant Examiner* — Henok Heyi
(74) *Attorney, Agent, or Firm* — Morrison & Foerster LLP

(57) ABSTRACT

The present invention includes, in addition to transistors each (Mm,n) provided at the intersection of a gate bus line (GLn) with a data bus line (DLm): block potential applying transistors (DMn) connected to respective ends of gate bus lines (GLn) which ends are not connected to a gate driver (11); a potential supply line (VLL) connected to the gate bus lines (GLn) via the block potential applying transistors (DMn); and a blocking signal supplying section (131) for, immediately after the gate driver (11) supplies a first conduction signal for bringing the transistors (Mm,n) into conduction, supplying to the block potential applying transistors (DMn), a second conduction signal for bringing the block potential applying transistors (DMn) into conduction.

6 Claims, 6 Drawing Sheets

(56) References Cited

FOREIGN PATENT DOCUMENTS

| | | |
|---|---|---|
| JP | 7-294882 | 11/1995 |
| JP | 8-327979 | 12/1996 |
| JP | 10-253940 | 9/1998 |
| JP | 2000-242241 | 9/2000 |
| JP | 2002-108310 | 4/2002 |
| JP | 2008-9368 | 1/2008 |

* cited by examiner

DISPLAY PANEL, LIQUID-CRYSTAL DISPLAY DEVICE AND DRIVE METHOD

REFERENCE TO RELATED APPLICATIONS

This application is a national stage application under 35 USC 371 of International Application No. PCT/JP2010/069202, filed Oct. 28, 2010, which claims priority from Japanese Patent Application No. 2009-288446, filed Dec. 18, 2009, the entire contents of which are incorporated herein by reference.

FIELD OF THE INVENTION

The present invention relates to a display panel for displaying an image with use of liquid crystal, and also to a liquid crystal display device including such a display panel.

BACKGROUND OF THE INVENTION

Recent years have witnessed an increasing number of liquid crystal display devices in use. A liquid crystal display device includes a display panel for displaying an image. A display panel includes, provided therein, a liquid crystal driving circuit for driving liquid crystal.

A display panel includes a plurality of pixels, each of which includes liquid crystal and a thin film transistor (TFT) for driving the liquid crystal.

A display panel further includes: gate bus lines each for supplying a gate signal (in the form of a pulse) to the gate electrode of a thin film transistor; and data bus lines each for supply a data signal to the source electrode of a thin film transistor. A thin film transistor includes a drain electrode connected to a corresponding pixel electrode. A thin film transistor is switched between a non-conductive state and a conductive state in correspondence with the value of the gate signal. A data signal to a data bus line is supplied to a pixel electrode only when the corresponding thin film transistor is in the conductive state.

A gate bus line normally has an internal resistance and an internal capacitance. These internal resistance and internal capacitance cause the pulse of a gate signal propagating through a gate bus line to have an edge with a distortion (round-off) corresponding to the distance over which the gate signal propagates through the gate bus line. A gate signal, in particular, has a longer tail in correspondence with a longer distance over which the gate signal propagates through a gate bus line.

Such a tail problematically causes a thin film transistor to supply a data signal to its corresponding pixel electrode at a timing at which the thin film transistor is supposed to block such a data signal.

Patent Literature 1 discloses (i) a system for driving a liquid crystal display device, the system including delaying means for delaying a source signal (data signal) for each source line (data bus line) and (ii) a system for driving a liquid crystal display device, the system including delaying means for delaying a gate signal for each gate line (gate bus line).

The technique disclosed in Patent Literature 1, however, provides the delaying means to each data bus line or each gate bus line, and thus problematically leads to a complicated configuration for a liquid crystal driving circuit provided to the display panel.

There has conventionally been known a two-sided driving system that (i) provides a liquid crystal driving circuit on each side of the display section of a display panel and (ii) supplies a gate signal to a gate bus line from both ends thereof. This system prevents a tail in the pulse of a gate signal. This system, however, requires a large space, for providing a liquid crystal driving circuit, on each side of the display section of a display panel. This system is thus problematic in that it is difficult to apply to a liquid crystal display device, such as a portable liquid crystal terminal, for which it is essential to reduce space that it takes up.

Japanese Patent Application Publication, Tokukai, No. 2000-242241 A (Publication Date: Sep. 8, 2000)

SUMMARY OF THE INVENTION

The present invention has been accomplished in view of the above problem. It is an object of the present invention to provide a display panel that can, with use of a simple element, remove a tail in a gate signal without requiring a large space on a side of the display section of a display panel which side is opposite to a side facing a liquid crystal driving circuit.

In order to solve the above problem, a display panel of the present invention includes: a plurality of gate bus lines; a plurality of source bus lines; first transistors each of which is provided in a vicinity of an intersection of a gate bus line with a source bus line and having a gate connected to the gate bus line; and pixel electrodes each connected to a source bus line via a first transistor, the display panel further including: first signal supplying means connected to respective first ends of the plurality of gate bus lines and supplying, to at least one of the plurality of gate bus lines, a first conduction signal for bringing the first transistors into conduction; second transistors provided for the plurality of respective gate bus lines and each having (i) a drain connected to a second end of a corresponding one of the plurality of gate bus lines and (ii) a gate connected to a common control line; a potential supply line connected in parallel to the respective second ends of the plurality of gate bus lines via the second transistors; potential supplying means for supplying to the potential supply line a potential for maintaining the first transistors in a non-conductive state; and second signal supplying means for, immediately after the first signal supplying means ends the supply of the first conduction signal, supplying to the control line a second conduction signal for bringing the second transistors into conduction.

A gate bus line normally has an internal resistance and an internal capacitance. These internal resistance and internal capacitance cause a gate signal propagating through the gate bus line to have, in its waveform, a distortion (round-off) corresponding to the propagation distance. Thus, the first conduction signal for bringing the first transistor into conduction has a longer tail in correspondence with a longer distance over which the first conduction signal propagates through a gate bus line. In other words, the gate signal has a tail that is longest in the vicinity of the second ends.

Such a tail in the first conduction signal problematically causes a pixel electrode to unfortunately receive a data signal supplied as a source signal and corresponding to a timing at which the data signal is supposed to be blocked.

The display panel of the present invention, arranged as above, includes: second transistors each having (i) a drain connected to a second end of a corresponding one of the plurality of gate bus lines and (ii) a gate connected to a common control line; a potential supply line connected in parallel to the respective second ends of the plurality of gate bus lines via the second transistors; and potential supplying means for supplying to the potential supply line a potential for maintaining the first transistor in a non-conductive state. Further, the second signal supplying means can, immediately after the first signal supplying means ends the supply of the first conduction signal, supply to the control line a second conduction signal for bringing the second transistors into conduction. The present invention can thus achieve an advantage of removing a tail caused in a gate signal propagating through a gate bus line.

The second transistors, which are connected to the respective second ends, can efficiently remove a tail caused in a gate signal particularly in the vicinity of the second ends.

Further, the above display panel can remove a tail in a gate signal by providing simple elements requiring no large space to be formed, that is, the second transistors, to the respective second ends of the gate bus lines.

Thus, the above arrangement can, with use of a simple element without requiring a large space in a region on a side of the display panel which side is opposite to a side on which a liquid crystal driving circuit (that is, the first signal supplying means) is provided, advantageously solve the above problem, caused by a tail, of a pixel electrode unfortunately receiving a data signal supplied as a source signal and corresponding to a timing at which the data signal is supposed to be blocked. In other words, the use of a liquid crystal panel of the present invention, arranged as above, can advantageously solve the above problem, caused by a tail, even in a liquid crystal display device, such as a portable liquid crystal terminal, for which it is essential to reduce space that it takes up.

A driving method of the present invention is a driving method for driving a display panel, the display panel including: a plurality of gate bus lines; a plurality of source bus lines; first transistors each of which is provided in a vicinity of an intersection of a gate bus line with a source bus line and having a gate connected to the gate bus line; pixel electrodes each connected to a source bus line via a first transistor; second transistors each having (i) a drain connected to a first end of a corresponding one of the plurality of gate bus lines and (ii) a gate connected to a common control line; a potential supply line connected in parallel to the respective first ends of the plurality of gate bus lines via the second transistors; and potential supplying means for supplying to the potential supply line a potential for maintaining the first transistors in a non-conductive state, the driving method including the steps of: a first signal supplying step for connecting to respective second ends of the plurality of gate bus lines and supplying, to at least one of the plurality of gate bus lines, a first conduction signal for bringing the first transistors into conduction; and a second signal supplying step for, immediately after the first signal supplying step ends the supply of the first conduction signal, supplying to the control line a second conduction signal for bringing the second transistors into conduction.

The above method achieves an advantage similar to the advantage achieved by the above display panel.

As described above, a display panel of the present invention includes: a plurality of gate bus lines; a plurality of source bus lines; first transistors each of which is provided in a vicinity of an intersection of a gate bus line with a source bus line and having a gate connected to the gate bus line; and pixel electrodes each connected to a source bus line via a first transistor, the display panel further including: first signal supplying means connected to respective first ends of the plurality of gate bus lines and supplying, to at least one of the plurality of gate bus lines, a first conduction signal for bringing the first transistors into conduction; second transistors provided for the plurality of respective gate bus lines and each having (i) a drain connected to a second end of a corresponding one of the plurality of gate bus lines and (ii) a gate connected to a common control line; a potential supply line connected in parallel to the respective second ends of the plurality of gate bus lines via the second transistors; potential supplying means for supplying to the potential supply line a potential for maintaining the first transistors in a non-conductive state; and second signal supplying means for, immediately after the first signal supplying means ends the supply of the first conduction signal, supplying to the control line a second conduction signal for bringing the second transistors into conduction.

The above arrangement can thus, with use of a simple element without requiring a large space in a region on a side of the display panel which side is opposite to a side on which a liquid crystal driving circuit (that is, the first signal supplying means) is provided, solve the above problem of a pixel electrode unfortunately receiving a data signal supplied as a source signal and corresponding to a timing at which the data signal is supposed to be blocked.

DETAILED DESCRIPTION OF THE DRAWINGS

Embodiment 1

Figure 1:
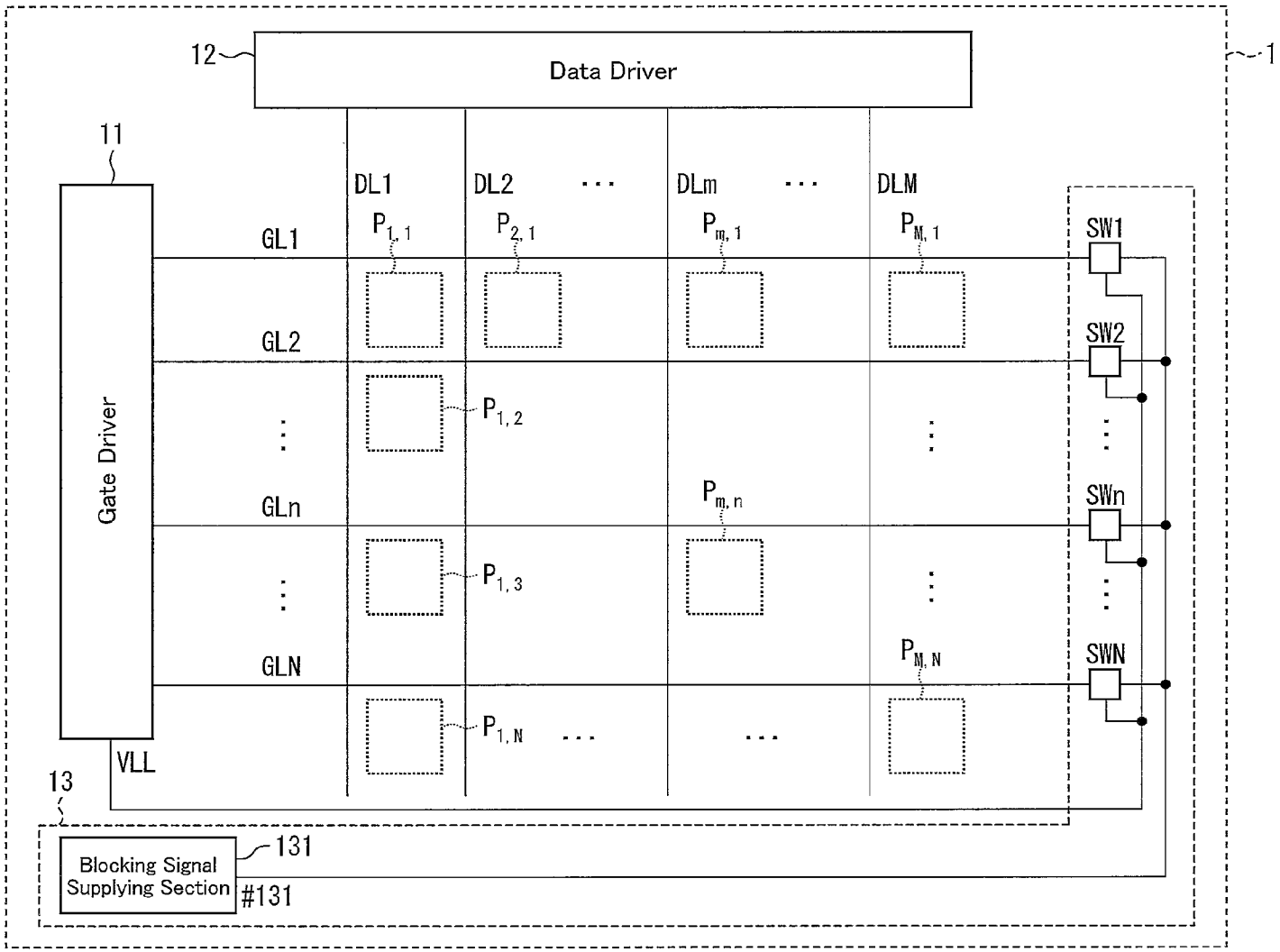
FIG. 1 is a block diagram illustrating a configuration of a display panel of a first embodiment.
Figure 2:
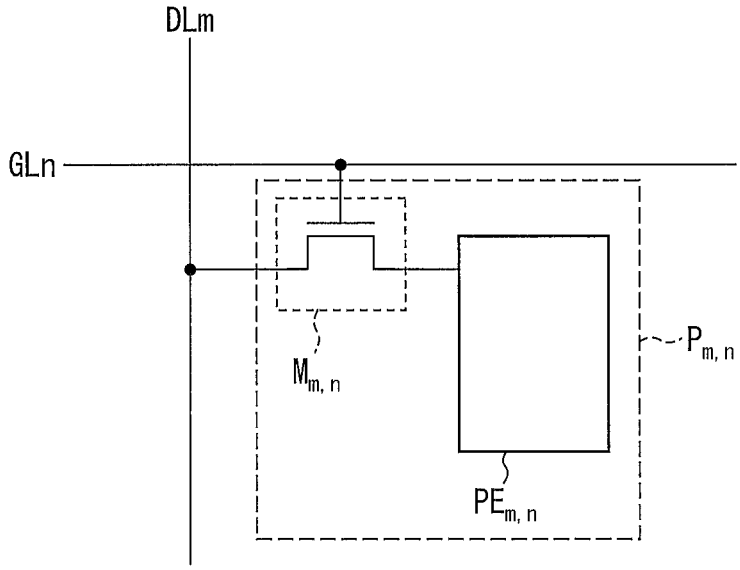
FIG. 2 is a circuit diagram illustrating a configuration of a pixel region in the display panel.

The following description deals with an arrangement of a display panel of the present embodiment with reference to FIGS. 1 and 2.

FIG. 1 is a block diagram illustrating a configuration of the display panel 1 of the present embodiment.

The display panel 1 is an active matrix liquid crystal display panel, and includes: gate bus lines; data bus lines crossing the gate bus lines; and an insulating film separating the gate bus lines from the data bus lines.

The display panel 1, as illustrated in FIG. 1, includes N gate bus lines GL1, GL2, . . . , GLN and M data bus lines DL1, DL2, . . . , DLM, and further includes a pixel region Pm,n defined by (i) an n-th gate bus line GLn (where n is an integer that satisfies $1 \leq n \leq N$) and (ii) an m-th data bus line DLm (where m is an integer that satisfies $1 \leq m \leq M$).

For convenience of explanation, the M data bus lines included in the display panel 1 are assigned a subscript m (where 1≤m≤M) in an ascending order from a data bus line close to the gate driver 11, whereas the N gate bus lines included in the display panel 1 are assigned a subscript n (where 1≤n≤N) in an ascending order from a gate bus line close to the data driver 12 (see FIG. 1). The description below uses the term "display section" to refer to a region constituted by pixel regions Pm,n (where 1≤m≤M and 1≤n≤N).

The display panel 1, as illustrated in FIG. 1, includes a gate driver 11, a data driver 12, and a voltage applying section 13.

The gate driver 11 supplies, to the N gate bus lines GL1 to GLN, respective gate signals #GL1 to #GLN each having (i) a potential VH at a high level or (ii) a potential VL at a low level. The gate driver 11 further supplies a potential VL to a potential supply line VLL. The data driver 12 supplies, to the M data bus lines DL1 to DLM, respective data signals #DL1 to #DLM each having (i) a potential VDH at a high level or (ii) a potential VDL at a low level.

The voltage applying section 13 includes (i) a blocking signal supplying section 131 and (ii) switch sections SW1 to SWN connected to respective ends of the gate bus lines GL1 to GLN which ends are not connected to the gate driver 11. The switch sections SW1 to SWN are each supplied with the potential VL via the potential supply line VLL. The blocking signal supplying section 131 supplies a blocking signal #131 to each of the switch sections SW1 to SWN. The switch sections SW1 to SWN each, in correspondence with the value of the blocking signal #131, either electrically connect a corresponding one of the gate bus lines GL1 to GLN with the potential supply line VLL or electrically break such a connection. The blocking signal supplying section 131 is, as illustrated in FIG. 1, provided in the display panel 1 closely to the gate driver 11. The voltage applying section 13 will be described later in further detail, and is thus not described here.

FIG. 2 is a circuit diagram illustrating how the display panel 1 is configured at a pixel region Pm,n. As illustrated in FIG. 2, the display panel 1 includes, in the pixel region Pm,n, a transistor Mm,n having (i) a gate electrode connected to a gate bus line GLn, (ii) a source electrode connected to a data bus line DLm, and (iii) a drain electrode connected to a pixel electrode PEm,n. While the transistor Mm,n is specifically a TFT, the present invention is not limited by a specific type of the transistor.

The transistor Mm,n is switched, in correspondence with the level of a gate signal supplied from the gate bus line GLn, from a non-conductive state to a conductive state or from the conductive state to the non-conductive state. When in the conductive state, the transistor Mm,n supplies, to the pixel electrode PEm,n, an electric charge corresponding to the level of a data signal supplied from the data bus line DLm.

The pixel electrode PEm,n and a common electrode (not shown) produce therebetween an electric field corresponding to the electric charge on the pixel electrode PEm,n. This electric field changes, in correspondence with its intensity, the state of liquid crystal provided between the pixel electrode PEm,n and the common electrode. The state of the liquid crystal in turn determines light transmittance for the pixel region Pm,n; in other words, the state of the liquid crystal determines the gray level for the pixel region Pm,n.

Figure 3:
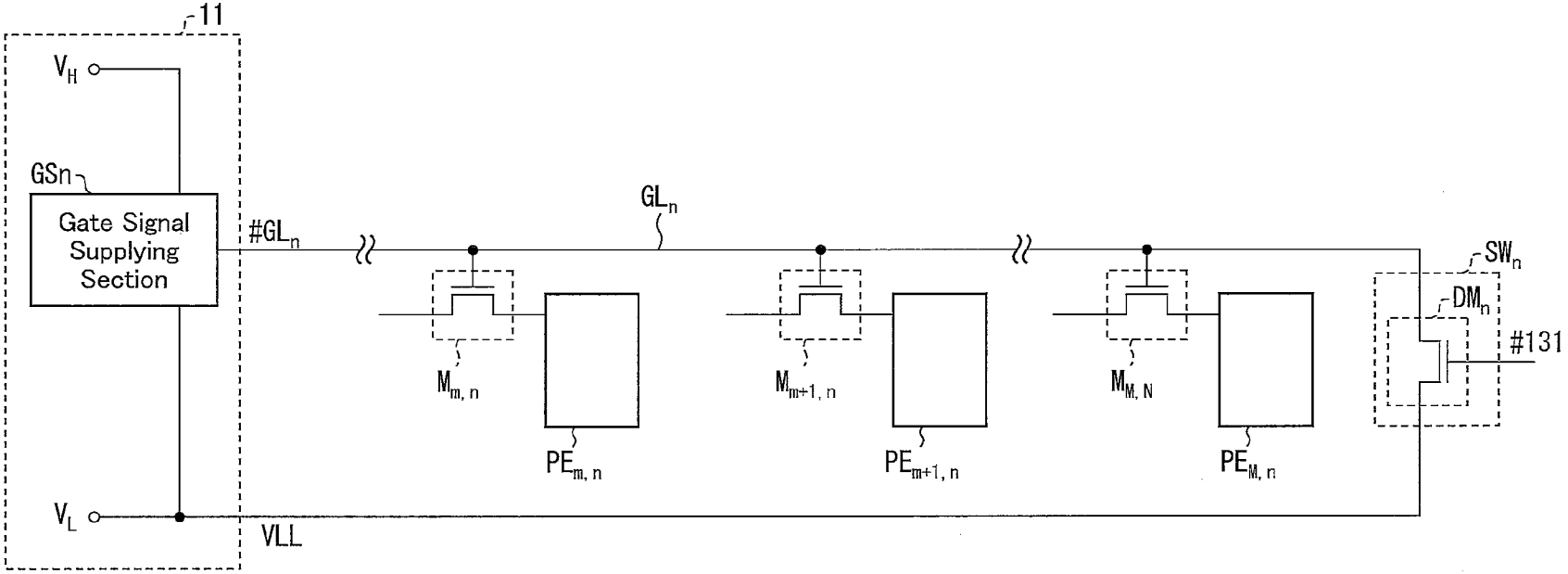
FIG. 3 is a circuit diagram of the configuration of the display panel of the first embodiment, the circuit diagram illustrating respective configurations of individual sections connected to an n-th gate bus line.

The description below deals with an arrangement of the display panel 1 by particularly looking at the n-th gate bus line GLn (where 1≤n≤N) with reference to FIG. 3. FIG. 3 is a circuit diagram illustrating a configuration of individual sections connected to the gate bus line GLn.

The gate driver 11, as illustrated in FIG. 3, includes: a high-potential source VH (having the potential VH); a low-potential source VL (having the potential VL); and a gate signal supplying section GSn (where 1≤n≤N). The gate signal supplying section GSn supplies a gate signal #GLn to the gate bus line GLn.

The gate bus line GLn is, as illustrated in FIG. 3, connected to the gate electrode of the transistor Mm,n (where 1≤m≤M). FIG. 3 omits the data bus line DLm.

The gate signal #GLn is a pulse signal having (i) a potential VH at a high level or (ii) a potential VL at a low level. The description below assumes that the transistor Mm,n is (i) in the conductive state when the gate signal #GLn is at the high level and (ii) in the non-conductive state when the gate signal #GLn is at the low level. The present invention is, however, not limited to such an arrangement. The present invention is also applicable to an arrangement in which the transistor Mm,n is (i) in the conductive state when the gate signal #GLn is at the low level and (ii) in the non-conductive state when the gate signal #GLn is at the high level.

The switch section SWn of the present embodiment, as illustrated in FIG. 3, includes a block potential applying transistor DMn, which has a gate electrode that is supplied with the blocking signal #131 from the blocking signal supplying section 131.

The block potential applying transistor DMn has a source electrode connected to an end of the gate bus line GLn which end is not connected to the gate signal supplying section GSn. The block potential applying transistor DMn has a drain electrode connected to the low-potential source VL via the potential supply line VLL.

The block potential applying transistor DMn is (i) in the conductive state when the blocking signal #131 is at a high level and (ii) in the non-conductive state when the blocking signal #131 is at a low level.

Figure 4:
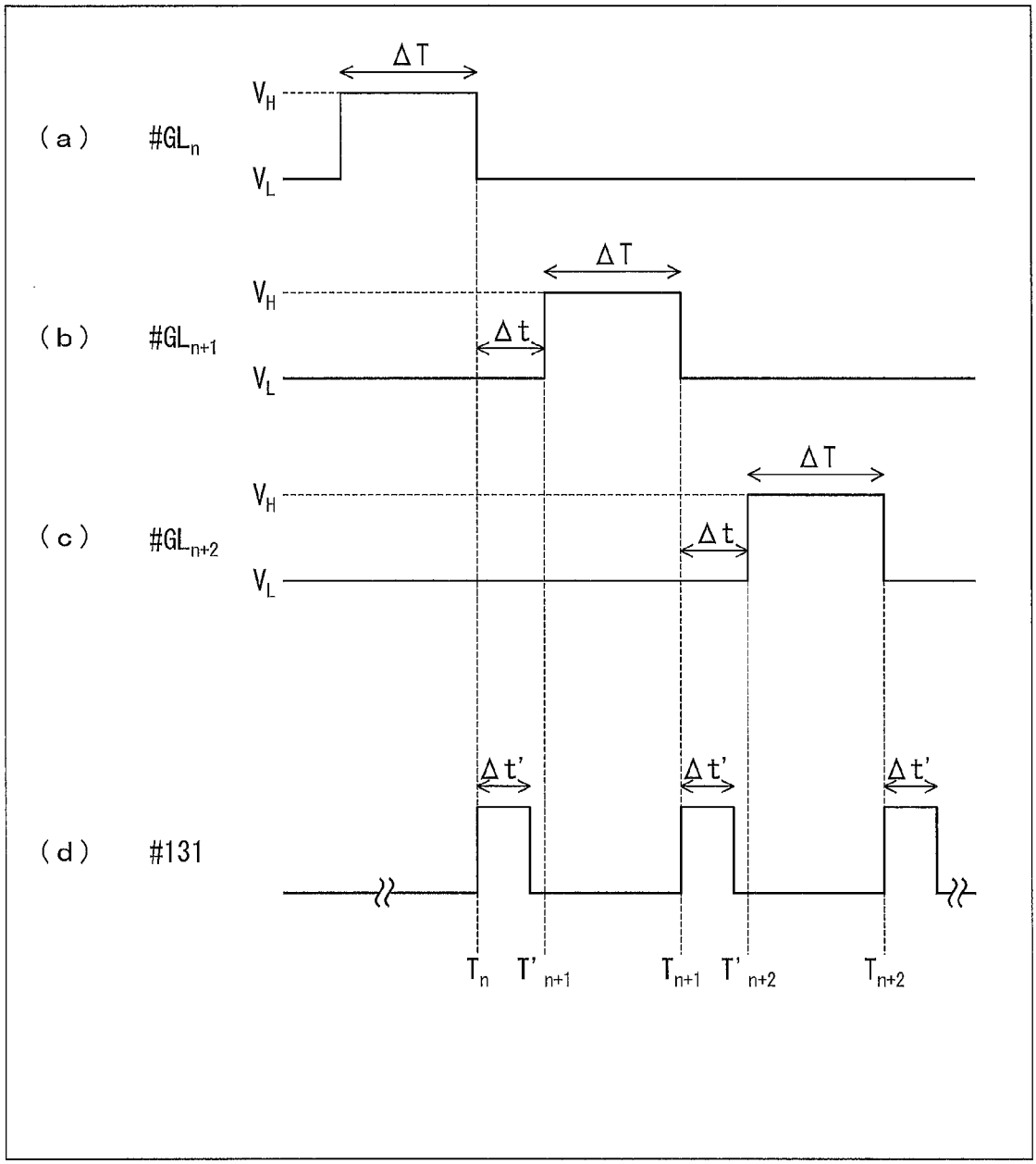
FIG. 4 is a diagram illustrating signals outputted by individual sections of the display panel of the first embodiment, where (a), (b), and (c) are timing charts for respective gate signals that a gate driver supplies to an n-th gate bus line, an (n+1)th gate bus line, and an (n+2)th gate bus line, and (d) is a timing chart for a blocking signal that a blocking signal supplying section outputs.

The following describes, with reference to (a) through (d) of FIG. 4, specific examples of the gate signal #GLn (where 1≤n≤N) and the blocking signal #131.

(a), (b), and (c) of FIG. 4 are timing charts for respective gate signals #GLn, #GLn+1, and #GLn+2 that the gate driver 11 supplies to the gate bus lines GLn, GLn+1, and GLn+2. (d) of FIG. 4 is a timing chart for the blocking signal #131 that the blocking signal supplying section 131 outputs.

The gate signal #GLn is, as illustrated in (a) through (c) of FIG. 4, a pulse signal having (i) a high potential VH during a high-level period ΔT and (ii) a low potential VL during the remaining period. As illustrated in (a) through (c) of FIG. 4, the gate signals #GLn, #GLn+1, and #GLn+2 are outputted at predetermined pulse intervals Δt. This description applies also to the other gate signals #GLk (k is an integer that satisfies 1≤k≤n−1 and n+3≤k≤N).

The blocking signal #131 is a periodic pulse signal that (i) rises from the low level to the high level in synchronization with the timing Tn of a fall of the gate signal #GLn (where 1≤n≤N) and then (ii) falls after a high-level period Δt' has elapsed.

In the present embodiment, the high-level period Δt' of the blocking signal #131 has a length that is not longer than the length of the high-level period ΔT of the gate signal #GLn (where 1≤n≤N).

(Advantage of Display Panel 1)

The following describes an advantage achieved by the display panel 1 of the present embodiment having the above arrangement. The description below deals first with (i) a comparative arrangement involving no voltage applying section 13 with reference to (a) and (b) of FIG. 5 and then with (ii) the arrangement involving the voltage applying section 13 with reference to (c) and (d) of FIG. 5.

Figure 5:
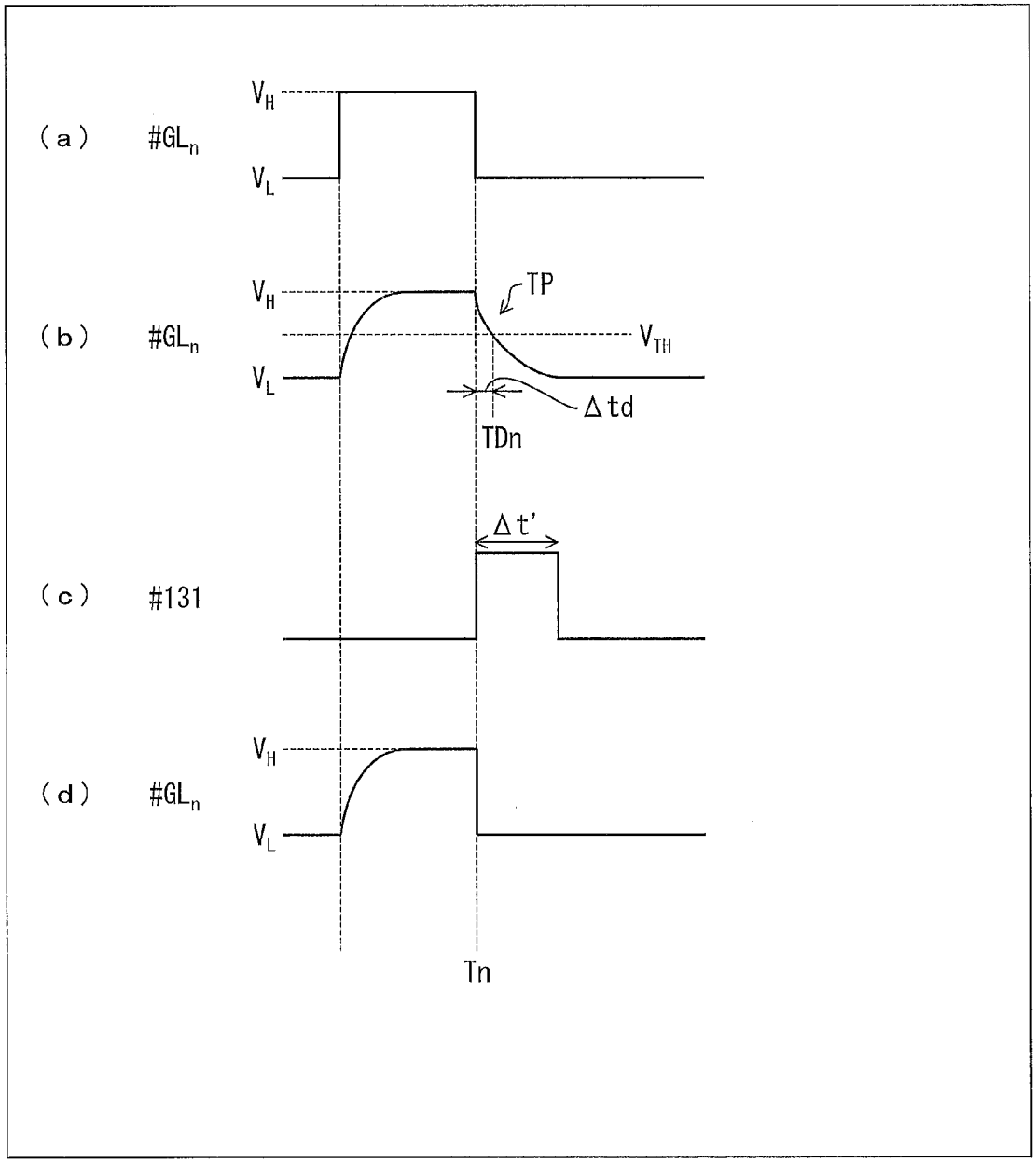
FIG. 5 is a diagram illustrating an advantage achieved by the display panel of the first embodiment, where (a) illustrates the waveform of a gate signal outputted by the gate driver, (b) illustrates the waveform of a gate signal that is generated in an arrangement involving no voltage applying section and that has propagated through a gate bus line, (c) illustrates a blocking signal that the blocking signal supplying section outputs, and (d) illustrates the waveform of a gate signal that is generated in an arrangement involving a voltage applying section and that has propagated through a gate bus line.

The gate bus line GLn (where 1≤n≤N) normally has an internal resistance and an internal capacitance. These internal resistance and internal capacitance cause the gate signal #GLn propagating through the gate bus line GLn to have, in its waveform, a distortion (round-off) corresponding to the distance of the propagation. (a) of FIG. 5 is a diagram illustrating the waveform of a gate signal #GLn occurring immediately after it has been outputted by the gate driver 11. (b) of FIG. 5 is a diagram illustrating the waveform of a gate signal #GLn occurring after it has propagated through the gate bus line GLn over a certain distance.

As illustrated in (a) and (b) of FIG. 5, the gate signal #GLn starts to have a distortion as it propagates through the gate bus line GLn. Further, the longer the propagation distance, the larger the distortion in the gate signal #GLn. In particular, the fall of the gate signal #GLn has an edge with a tail TP as illustrated in (b) of FIG. 5, the tail having a larger length with a longer propagation distance.

In the case where the gate signal #GLn has a tail TP, the transistor Mm,n connected to the gate bus line GLn is not switched to the non-conductive state at the timing Tn at which it is supposed to be switched to the non-conductive state, and unfortunately remains in the conductive state even after the timing Tn for a certain period.

More specifically, supposing that the transistor Mm,n has a threshold potential VTH, there is caused a delay time Δtd, as illustrated in (b) of FIG. 5, between (i) the timing (that is, the timing Tn) at which the potential of the gate signal #GLn starts to fall and (ii) the timing (that is, a timing TDn) at which the potential of the gate signal #GLn reaches the threshold potential VTH. Thus, upon receipt of the gate signal #GLn as illustrated in (b) of FIG. 5, the transistor Mm,n unfortunately remains in the conductive state even after the start of a fall of the potential of the gate signal #GLn for the delay time Δtd.

The delay time Δtd has a larger length with a longer distance over which the gate signal #GLn propagates through the gate bus line GLn. This indicates that the gate signal #GLn supplied to a transistor Mm+r,n (where r is an integer of 1 or greater) has a delay time Δtd with a length that is larger than that of the delay time Δtd in the gate signal #GLn supplied to the transistor Mm,n.

The delay time Δtd problematically causes the pixel electrode PEm,n to receive a data signal corresponding to a timing at which the data signal is supposed to be blocked.

This problem is solved by the use of the voltage applying section 13 included in the present invention. The following describes the arrangement involving the voltage applying section 13 with reference to (c) and (d) of FIG. 5.

(c) of FIG. 5 illustrates the waveform of a blocking signal #131 that the blocking signal supplying section 131 supplies to the gate electrode of a block potential applying transistor DMn. The blocking signal #131, as illustrated in (c) of FIG. 5, (i) rises from the low level to the high level in synchronization with the timing at which the gate signal #GLn starts to fall and then (ii) falls after the high-level period Δt' has elapsed.

In response to the rise of the blocking signal #131 to the high level, the block potential applying transistor DMn is switched to the conductive state. This switching of the block potential applying transistor DMn to the conductive state causes the gate bus line GLn to have a potential equal to the potential VL. In other words, the rise of the blocking signal #131 at the timing of the start of a fall of the gate signal #GLn causes the gate bus line GLn to start having a potential equal to the potential VL at the same timing of the start of the fall of the gate signal #GLn.

The tail TP caused in the gate signal #GLn in an arrangement involving no voltage applying section 13 is thus removed by the use of the voltage applying section 13. Specifically, the use of the voltage applying section 13 causes the gate signal #GLn supplied to the transistor Mm,n to have a waveform as illustrated in (d) of FIG. 5. More specifically, the gate signal #GLn supplied to the transistor Mm,n falls from the potential VH to the potential VL immediately at the timing Tn.

The above description applies also to the other gate signals #GLk (where k≠n).

The use of the voltage applying section 13 thus eliminates the possibility of a delay time Δtd being caused, and solves the problem of the pixel electrode PEm,n (where 1≤m≤M and 1≤n≤N) unfortunately receiving a data signal corresponding to a timing at which the data signal is supposed to be blocked.

Further, the present embodiment solves the above problem involving a delay time Δtd by providing a simple element, that is, a block potential applying transistor DMn, to an end of the gate bus line GLn (where 1≤n≤N) which end is not connected to the gate driver 11.

The block potential applying transistor DMn, which can be provided without requiring a large space, solves the above problem involving a delay time Δtd without requiring a large space on a side of the display section which side is opposite to a side facing the gate driver 11.

The blocking signal #131, as described above, rises from the low level to the high level in synchronization with the timing at which the gate signal #GLn starts to fall. This is achievable by, for example, the arrangement described below.

The gate driver 11 supplies, to the blocking signal supplying section 131, a clock signal specifying the timing at which each of the gate signals #GL1 to #GLN rises from the low level to the high level. The blocking signal supplying section 131 thus supplies a blocking signal #131 that rises from the low level to the high level at the timing specified by the clock signal.

If the blocking signal #131 has an unignorable delay time between (i) the timing at which it is outputted by the blocking signal supplying section 131 and (ii) the timing at which it reaches the switch sections SW1 to SWN, the blocking signal supplying section simply needs to supply the blocking signal #131 that rises from the low level to the high level at a timing that is earlier by that delay time.

The description above states that (i) the pulse interval Δt between the gate signals #GLn and #GLn+1 (where 1≤n≤N−1) is constant and that (ii) the blocking signal #131 is a periodic pulse signal. The present invention is, however, not limited to such an arrangement. Specifically, the present invention may alternatively be arranged such that the pulse interval Δt is not constant, in which case the blocking signal #131 is accordingly a nonperiodic pulse signal that synchronizes with the timing of a fall of each of the gate signals #GL1 to #GLN.

The description above states that the blocking signal supplying section 131 supplies a common blocking signal #131 to all the switch sections SW1 to SWN. The present invention is, however, not limited to such an arrangement. Specifically, the present invention may alternatively be arranged such that (i) the blocking signal supplying section 131 supplies, to the block potential applying transistors DM1 to DMN, respective blocking signals separate from one another and that (ii) the switch sections SW1 to SWN each, in correspondence with the value of a corresponding one of the separate blocking signals, either electrically connect a corresponding one of the gate bus lines GL1 to GLN with the low-potential source VL or electrically break such a connection.

The description above states that the switch section SWn (where 1≤n≤N) includes a block potential applying transistor DMn. The present invention is, however, not limited to such an arrangement. The present invention can be implemented with use of any element having a switch function similar to that of the block potential applying transistor DMn.

As described above, the display panel 1 of the present invention includes: a plurality of gate bus lines GLn (where 1≤n≤N); a plurality of source bus lines (gate bus lines GLm [where 1≤m≤M]); first transistors (transistors Mm,n) each of which is provided in a vicinity of an intersection of a gate bus line with a source bus line and having a gate connected to the gate bus line; and pixel electrodes PEm,n each connected to a source bus line via a first transistor, the display panel further including: first signal supplying means (gate driver 11) connected to respective first ends of the plurality of gate bus lines and supplying, to at least one of the plurality of gate bus lines, a first conduction signal for bringing the first transistors into conduction; second transistors (block potential applying transistors DMn) provided for the plurality of respective gate bus lines and each having (i) a drain connected to a second end of a corresponding one of the plurality of gate bus lines and (ii) a gate connected to a common control line; a potential supply line VLL connected in parallel to the respective second ends of the plurality of gate bus lines via the second transistors; potential supplying means (gate driver 11) for supplying to the potential supply line a potential for maintaining the first transistors in a non-conductive state; and second signal supplying means (blocking signal supplying section 131) for, immediately after the first signal supplying means ends the supply of the first conduction signal, supplying to the control line a second conduction signal for bringing the second transistors into conduction.

The above arrangement can, with use of a simple element without requiring a large space in a region on a side of the display panel which side is opposite to a side on which a liquid crystal driving circuit (that is, the first signal supplying means) is provided, solve the above problem, caused by a tail in a gate signal, of a pixel electrode unfortunately receiving a data signal supplied as a source signal and corresponding to a timing at which the data signal is supposed to be blocked.

Embodiment 2

The description above deals with an arrangement in which the switch sections SW1 to SWN are connected to only respective ends of the gate bus lines GL1 to GLN which ends are not connected to the gate driver 11. The present invention is, however, not limited to such an arrangement. The description below deals with a second embodiment of the present invention with reference to the FIG. 6. Members of the present embodiment that are identical to respective corresponding members described above are each assigned a common reference numeral, and are not described here.

Figure 6:
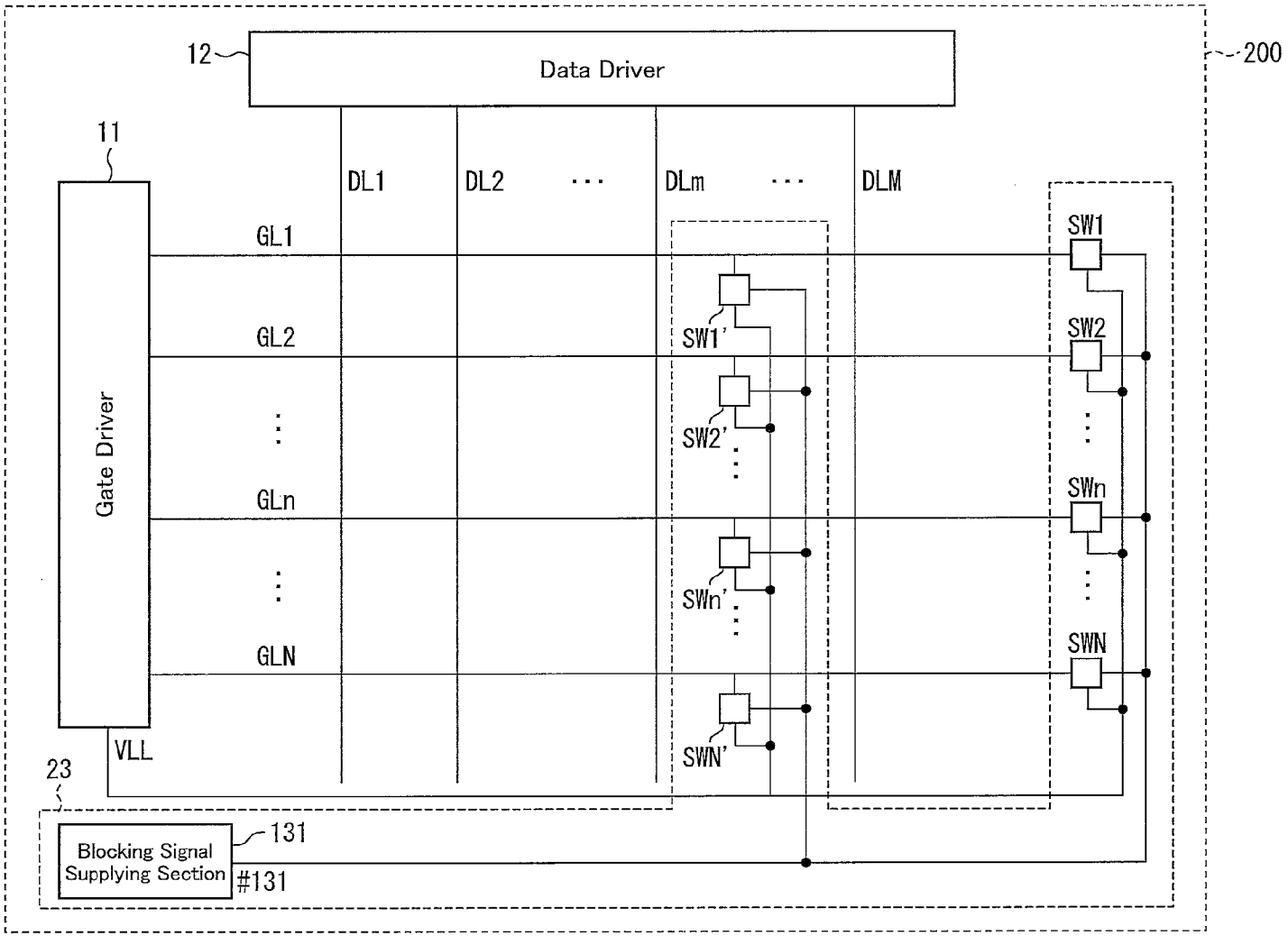
FIG. 6 is a block diagram illustrating a configuration of a display panel of a second embodiment.

FIG. 6 is a block diagram illustrating a configuration of a display panel 200 of the present embodiment. The display panel 200, as illustrated in FIG. 6, includes a voltage applying section 23 in place of the voltage applying section 13 included in the display panel 1.

The voltage applying section 23 includes switch sections SW1' to SWN' in addition to a blocking signal supplying section 131 and switch sections SW1 to SWN.

The switch sections SW1' to SWN' are each, as illustrated in FIG. 6, connected to a portion of a corresponding one of the gate bus lines GL1 to GLN which portion is defined by a data bus line DLm. The switch sections SW1' to SWN' are also each connected to a potential supply line VLL. The switch sections SW1' to SWN' each (i) have a specific configuration similar to that of each of the switch sections SW1 to SWN, and (ii) also receive a blocking signal #131.

Similarly to the switch sections SW1 to SWN, the switch sections SW1' to SWN' each change the potential of a corresponding one of the gate bus lines GL1 to GLN to a low potential VL at the timing at which a corresponding one of the gate signals #GL1 to #GLN starts to fall.

As described above, the display panel 200 includes: third transistors (switch sections SW1' to SWN') provided for the plurality of respective gate bus lines and each having (i) a drain connected to a portion of a corresponding one of the plurality of gate bus lines GLn which portion is defined by at least one (data bus line DLm) of the plurality of source bus lines (data bus lines DLm [where 1≤m≤M]) and (ii) a gate connected to the common control line, wherein: the potential supply line VLL is further connected in parallel to the portions of the plurality of gate bus lines via the third transistors.

The above arrangement can efficiently remove not only (i) a tail in a gate signal occurring in the vicinity of respective ends of the gate bus lines GL1 to GLN which ends are not connected to the gate driver 11, but also (ii) a tail in a gate signal occurring in the vicinity of respective portions of the gate bus lines which portions are defined by at least one of the plurality of source bus lines.

More specifically, the present embodiment can not only (i) cause the switch sections SW1 to SWN to each change a potential, occurring at an end of a corresponding one of the gate bus lines GL1 to GLN which end is not connected to the gate driver 11, to a low potential VL at the timing at which a corresponding one of the gate signals #GL1 to #GLN starts to fall, but also (ii) cause the switch sections SW1' to SWN' to each change a potential, occurring at a portion of a corresponding one of the gate bus lines GL1 to GLN which portion is defined by a data bus line DLm, to a low potential VL at the timing at which a corresponding one of the gate signals #GL1 to #GLN starts to fall. The present embodiment can thus more efficiently solve the above problem involving a delay time Δtd.

The description above deals with an arrangement in which the voltage applying section 23 includes a single switch section SWn' for each gate bus line GLn. The present invention is, however, not limited to such an arrangement. The voltage applying section 23 may alternatively include a plurality of switch sections SWn' for each gate bus line GLn. The present invention may thus be arranged, for example, such that (i) the pixel regions P1,n to PM,n defined by the gate bus line GLn are divided into segments each including two adjacent pixel regions and that (ii) the gate bus line GLn is provided with switch sections SWn' in correspondence with the individual segments each including two pixel regions. The present invention may alternatively be arranged such that (i) the pixel regions P1,n to PM,n defined by the gate bus line GLn are divided into segments each including four pixel regions and that (ii) the gate bus line GLn is provided with switch sections SWn' in correspondence with the individual segments each including four pixel regions. The present invention may further alternatively be arranged such that (i) the pixel regions Pm,n (where 1≤m≤M) defined by the gate bus line GLn are divided into segments each including a unit of adjacent RGB pixels and that (ii) the gate bus line GLn is provided with switch sections SWn' in correspondence with the individual units.

The above description applies also to the other gate bus lines GLk (where k≠n).

As described above, the display panel of the present invention may be arranged such that the third transistors (switch sections SW1' to SWN') are each provided for a first portion of a corresponding one of the plurality of gate bus lines GLn which first portion is defined by adjacent ones of the plurality of source bus lines (data bus lines DLm [where 1≤m≤M]); and the potential supply line DLL is connected in parallel to the first portions of the plurality of gate bus lines via the third transistors.

The above arrangement can more efficiently remove a tail in a gate signal.

In other words, the above arrangement can more efficiently solve the above problem involving a delay time Δtd.

The switch sections SWn' may be provide for the gate bus lines GLn with respect to all pixel regions Pm,n (where 1≤m≤M) defined by the respective gate bus lines GLn.

The above description applies also to the other gate bus lines GLk (where k≠n).

As described above, the display panel of the present invention may be arranged such that the third transistors (switch sections SW1' to SWN') are each provided for a second portion of a corresponding one of the plurality of gate bus lines GLn which second portion is defined by each individual one of the plurality of source bus lines (data bus lines DLm [where 1≤m≤M]); and the potential supply line VLL is connected in parallel to the second portions of the plurality of gate bus lines via the third transistors.

The above arrangement can more efficiently remove a tail in a gate signal.

In other words, the above arrangement can more efficiently solve the above problem involving a delay time Δtd.

(Supplemental Notes)

As described above, a display panel of the present invention includes: a plurality of gate bus lines; a plurality of source bus lines; first transistors each of which is provided in a vicinity of an intersection of a gate bus line with a source bus line and having a gate connected to the gate bus line; and pixel electrodes each connected to a source bus line via a first transistor, the display panel further including: first signal supplying means connected to respective first ends of the plurality of gate bus lines and supplying, to at least one of the plurality of gate bus lines, a first conduction signal for bringing the first transistors into conduction; second transistors provided for the plurality of respective gate bus lines and each having (i) a drain connected to a second end of a corresponding one of the plurality of gate bus lines and (ii) a gate connected to a common control line; a potential supply line connected in parallel to the respective second ends of the plurality of gate bus lines via the second transistors; potential supplying means for supplying to the potential supply line a potential for maintaining the first transistors in a non-conductive state; and second signal supplying means for, immediately after the first signal supplying means ends the supply of the first conduction signal, supplying to the control line a second conduction signal for bringing the second transistors into conduction.

A gate bus line normally has an internal resistance and an internal capacitance. These internal resistance and internal capacitance cause a gate signal propagating through the gate bus line to have, in its waveform, a distortion (round-off) corresponding to the propagation distance. Thus, the first conduction signal for bringing the first transistor into conduction has a longer tail in correspondence with a longer distance over which the first conduction signal propagates through a gate bus line. In other words, the gate signal has a tail that is longest in the vicinity of the second ends.

Such a tail in the first conduction signal problematically causes a pixel electrode to unfortunately receive a data signal supplied as a source signal and corresponding to a timing at which the data signal is supposed to be blocked.

The display panel of the present invention, arranged as above, includes: second transistors each having (i) a drain connected to a second end of a corresponding one of the plurality of gate bus lines and (ii) a gate connected to a common control line; a potential supply line connected in parallel to the respective second ends of the plurality of gate bus lines via the second transistors; and potential supplying means for supplying to the potential supply line a potential for maintaining the first transistor in a non-conductive state. Further, the second signal supplying means can, immediately after the first signal supplying means ends the supply of the first conduction signal, supply to the control line a second conduction signal for bringing the second transistors into conduction. The present invention can thus achieve an advantage of removing a tail caused in a gate signal propagating through a gate bus line.

The second transistors, which are connected to the respective second ends, can efficiently remove a tail caused in a gate signal particularly in the vicinity of the second ends.

Further, the above display panel can remove a tail in a gate signal by providing simple elements requiring no large space to be formed, that is, the second transistors, to the respective second ends of the gate bus lines.

Thus, the above arrangement can, with use of a simple element without requiring a large space in a region on a side of the display panel which side is opposite to a side on which a liquid crystal driving circuit (that is, the first signal supplying means) is provided, advantageously solve the above problem, caused by a tail, of a pixel electrode unfortunately receiving a data signal supplied as a source signal and corresponding to a timing at which the data signal is supposed to be blocked. In other words, the use of a liquid crystal panel of the present invention, arranged as above, can advantageously solve the above problem, caused by a tail, even in a liquid crystal display device, such as a portable liquid crystal terminal, for which it is essential to reduce space that it takes up.

The display panel of the present invention may preferably further include: third transistors provided for the plurality of respective gate bus lines and each having (i) a drain connected to a portion of a corresponding one of the plurality of gate bus lines which portion is defined by at least one of the plurality of source bus lines and (ii) a gate connected to the common control line, wherein: the potential supply line is further connected in parallel to the portions of the plurality of gate bus lines via the third transistors.

The display panel arranged as above includes third transistors each having (i) a drain connected to a portion of a corresponding one of the plurality of gate bus lines which portion is defined by at least one of the plurality of source bus lines and (ii) a gate connected to the common control line, wherein: the potential supply line is further connected in parallel to the portions of the plurality of gate bus lines via the third transistors. This arrangement can achieve a further advantage of efficiently removing not only (i) a tail in a gate signal occurring in the vicinity of the respective second ends of the gate bus lines, but also (ii) a tail in a gate signal occurring in the vicinity of respective portions of the gate bus lines which portions are defined by at least one of the plurality of source bus lines.

The display panel of the present invention may preferably be arranged such that the third transistors are each provided for a first portion of a corresponding one of the plurality of gate bus lines which first portion is defined by adjacent ones of the plurality of source bus lines; and the potential supply line is connected in parallel to the first portions of the plurality of gate bus lines via the third transistors.

According to the above arrangement, the third transistors are each provided for a first portion of a corresponding one of the plurality of gate bus lines which first portion is defined by adjacent ones of the plurality of source bus lines. This arrangement can achieve a further advantage of more efficiently removing a tail in a gate signal.

The display panel of the present invention may preferably be arranged such that the third transistors are each provided for a second portion of a corresponding one of the plurality of gate bus lines which second portion is defined by each individual one of the plurality of source bus lines; and the potential supply line is connected in parallel to the second portions of the plurality of gate bus lines via the third transistors.

According to the above arrangement, the third transistors are each provided for a second portion of a corresponding one of the plurality of gate bus lines which second portion is defined by each individual one of the plurality of source bus lines. This arrangement can achieve a further advantage of more efficiently removing a tail in a gate signal.

The present invention further encompasses a liquid crystal display device including the display panel.

A driving method of the present invention is a driving method for driving a display panel, the display panel including: a plurality of gate bus lines; a plurality of source bus lines; first transistors each of which is provided in a vicinity of an intersection of a gate bus line with a source bus line and having a gate connected to the gate bus line; pixel electrodes each connected to a source bus line via a first transistor; second transistors each having (i) a drain connected to a first end of a corresponding one of the plurality of gate bus lines and (ii) a gate connected to a common control line; a potential supply line connected in parallel to the respective first ends of the plurality of gate bus lines via the second transistors; and potential supplying means for supplying to the potential supply line a potential for maintaining the first transistors in a non-conductive state, the driving method including the steps of: a first signal supplying step for connecting to respective second ends of the plurality of gate bus lines and supplying, to at least one of the plurality of gate bus lines, a first conduction signal for bringing the first transistors into conduction; and a second signal supplying step for, immediately after the first signal supplying step ends the supply of the first conduction signal, supplying to the control line a second conduction signal for bringing the second transistors into conduction.

The above method achieves an advantage similar to the advantage achieved by the above display panel.

The present invention is not limited to the description of the embodiments above, but may be altered in various ways by a skilled person within the scope of the claims. Any embodiment based on a proper combination of technical means disclosed in different embodiments is also encompassed in the technical scope of the present invention.

The present invention further encompasses in its technical scope a liquid crystal display device including any of the display panels described in the above embodiments.

The present invention is suitably applicable to a display panel for displaying an image with use of liquid crystal.

The invention claimed is:

1. A display panel comprising:

a plurality of gate bus lines;

a plurality of source bus lines;

first transistors each of which is provided in a vicinity of an intersection of a gate bus line with a source bus line and having a gate connected to the gate bus line;

pixel electrodes each connected to a source bus line via a first transistor;

first signal supplying means connected to respective first ends of the plurality of gate bus lines and supplying, to at least one of the plurality of gate bus lines, a first conduction signal for bringing the first transistors into conduction;

second transistors provided for the plurality of respective gate bus lines and each having (i) a drain connected to a second end of a corresponding one of the plurality of gate bus lines and (ii) a gate connected to a common control line;

a potential supply line connected in parallel and common to the respective second ends of the plurality of gate bus lines via the second transistors;

potential supplying means for supplying to the potential supply line a potential for maintaining the first transistors in a non-conductive state; and second signal supplying means for, immediately after the first signal supplying means ends the supply of the first conduction signal, supplying to the control line a second conduction signal for bringing the second transistors into conduction, the first conduction signal being a pulse signal having (i) a high potential during a hi hg level period and (ii) a low potential du in a remaining period, the second conduction signal being a periodic pulse signal that (i) rises from a low level to a high level in synchronization with a timing of a fall of the first conduction signal and then (ii) falls after a high-level period has elapsed.

2. The display panel according to claim 1, further comprising:

third transistors provided for the plurality of respective gate bus lines and each having (i) a drain connected to a portion of a corresponding one of the plurality of gate bus lines which portion is defined by at least one of the plurality of source bus lines and (ii) a gate connected to the common control line, wherein:

the potential supply line is further connected in parallel to the portions of the plurality of gate bus lines via the third transistors.

3. The display panel according to claim 2, wherein:

the third transistors are each provided for a first portion of a corresponding one of the plurality of gate bus lines which first portion is defined by adjacent ones of the plurality of source bus lines; and the potential supply line is connected in parallel to the first portions of the plurality of gate bus lines via the third transistors.

4. The display panel according to claim 2, wherein:

the third transistors are each provided for a second portion of a corresponding one of the plurality of gate bus lines which second portion is defined by each individual one of the plurality of source bus lines; and the potential supply line is connected in parallel to the second portions of the plurality of gate bus lines via the third transistors.

5. A liquid crystal display device comprising:

the display panel according to claim 1.

6. A driving method for driving a display panel, the display panel including:

a plurality of gate bus lines;

a plurality of source bus lines;

first transistors each of which is provided in a vicinity of an intersection of a gate bus line with a source bus line and having a gate connected to the gate bus line;

pixel electrodes each connected to a source bus line via a first transistor;

second transistors each having (i) a drain connected to a first end of a corresponding one of the plurality of gate bus lines and (ii) a gate connected to a common control line;

a potential supply line connected in parallel and common to the respective first ends of the plurality of gate bus lines via the second transistors; and potential supplying means for supplying to the potential supply line a potential for maintaining the first transistors in a non-conductive state, the driving method comprising the steps of:

a first signal supplying step for connecting to respective second ends of the plurality of gate bus lines and supplying, to at least one of the plurality of gate bus lines, a first conduction signal for bringing the first transistors into conduction; and a second signal supplying step for, immediately after the first signal supplying step ends the supply of the first conduction signal, supplying to the control line a second conduction signal for bringing the second transistors into conduction, wherein the first conduction signal is a pulse signal having (i) a high potential during a high-level period and (ii) a low potential during a remaining period, and the second conduction signal is a periodic pulse signal that (i) rises from a low level to a high level in synchronization with a timing of a fall of the first conduction signal and then (ii) falls after a high-level has elapsed.

* * * * *